United States Patent [19]

Frey et al.

[11] Patent Number: 4,903,622

[45] Date of Patent: Feb. 27, 1990

[54] APPARATUS FOR GUIDING AND BRAKING BANDS IN SEWING MACHINES

[75] Inventors: Emmy Frey, Rorschach; Ernst Dreier, Steckborn, both of Switzerland

[73] Assignee: Fritz Gegauf Aktiengesellschaft Bernina-Nähmaschinenfabrik, Steckborn, Switzerland

[21] Appl. No.: 268,233

[22] Filed: Nov. 7, 1988

[30] Foreign Application Priority Data

Nov. 18, 1987 [CH] Switzerland ..... 4479/87

[51] Int. Cl.[4] ..... D05B 35/06

[52] U.S. Cl. ..... 112/152; 112/121.26; 112/137; 112/139; 112/305

[58] Field of Search ..... 33/42; 112/152, 121.26, 112/139, 257, 143, 305, 153, 235, , 306, 136, 137, 138, 140

[56] References Cited

U.S. PATENT DOCUMENTS

| | | | |
|---|---|---|---|
| 164,895 | 6/1875 | Wissler | 112/137 |
| 272,847 | 2/1883 | Bea, Jr. | 112/152 |
| 1,315,090 | 9/1919 | Chapman | 112/137 |
| 1,526,933 | 2/1925 | Rhyon | 112/152 X |
| 1,875,578 | 9/1932 | Feigel et al. | 112/136 |
| 2,625,126 | 1/1953 | Herman | 112/152 X |
| 2,653,559 | 9/1953 | Picucci | 112/152 |

FOREIGN PATENT DOCUMENTS 625279 12/1978 Switzerland .

*Primary Examiner*—Andrew M. Falik
*Attorney, Agent, or Firm*—Peter K. Kontler

[57] ABSTRACT

Apparatus for guiding and braking elastic or nonelastic bands during sewing to pieces of fabric has an elongated flat housing of rectangular cross-sectional outline with a transversely extending channel for a band. The housing is separably affixed to the table of a household sewing machine and contains a reciprocable slide which can alter the effective width of the channel. The slide is installed at one side of the channel, and the housing supports an adjustable fabric guide at the other side of the channel. A plate-like biasing member is installed in the channel at a level above the band, and the biasing member can be moved up or down by a screw having a knurled head so as to select the force with which the underside of the biasing member bears against the upper side of the band.

17 Claims, 2 Drawing Sheets

APPARATUS FOR GUIDING AND BRAKING BANDS IN SEWING MACHINES

BACKGROUND OF THE INVENTION

The invention relates to sewing machines in general, and more particularly to improvements in apparatus which can be used in sewing machines to guide and brake elastic or other bands during sewing of such bands to pieces of fabric or like commodities.

When a band, especially an elastic band, is to be sewn to a garment so that a portion of the garment is ruffled or gathered as a result of attachment of the band thereto, it is necessary to maintain the band under tension so that the band can contract when the sewing operation is completed and thus provides the adjacent portion of the garment with ruffles. The thus attached band can form part of the waistband of a skirt, the waistband of pajama slacks or the like.

It is already known to guide and brake a band or tape, such as an elastic band, in commercially used sewing machines so that the band is under tension during sewing to a piece of fabric or a like commodity. For example, Swiss Pat. No. 500,314 discloses an apparatus which is designed to feed elastic bands from a source adjacent the sewing machine into a funnel-shaped guide which is mounted on a pivotable arm adjacent to the locus of penetration of the needle into the band and into the piece of fabric to be connected with the band. The band is deflected through an angle of 90 degrees on its way from the source toward the funnel. Such band feeding apparatus is associated with a severing device which can cut across the band upon completion of the sewing operation. A drawback of the patented apparatus is its excessive cost and bulk. Therefore, such apparatus cannot be readily installed in or used in conjunction with a household sewing machine for occasional sewing of elastic or like bands to garments or like commodities. Furthermore, installation of such apparatus in a conventional sewing machine would necessitate extensive modifications of the machine.

Other types of apparatus for supplying bands to commercial sewing machines are disclosed in German Pat. No. 34 10 181 and in U.S. Pat. No. 4,649,839. The patented apparatus are not suitable for occasional use in household sewing machines.

Swiss Pat. No. 625 279 discloses an apparatus which can be used, as a means for tensioning elastic bands which are to be sewn to garments or like commodities in a household sewing machine. The patented apparatus comprises two plates which are connected to each other so as to define a passage of unvariable cross-sectional area. The band to be sewn in threaded through the passage and is acted upon by a plate-like biasing member which is movably mounted on the upper of the two plates and can be raised or lowered by a screw so as to bear against the upper side of the band with a selected braking and stretching force. A leaf spring is installed between the biasing member and the upper plate in order to lift the biasing member above and away from the band in the passage as soon as such upward movement is permitted by the screw. The patent proposes to employ two studs which are to be inserted into bores adjacent the locus of penetration of the needle into the band. The bores must be drilled into the frame of a sewing machine for the express purpose of receiving the studs. When the apparatus is installed in a sewing machine and the operator wishes to change the bias of the plate-like member upon the band in the passage, it is necessary to employ a screw driver or another tool which is manipulated to turn the screw and to thus move the biasing member upwardly away from or downwardly toward the band. The width of the passage is fixed so that the patented apparatus can be used only for the sewing of bands having a predetermined width. If a narrower band is to be sewn to a piece of fabric or the like, such narrower band must be guided by hand which is highly unlikely to result in attachment of the band in an eye-pleasing manner. Alternatively, it is necessary to furnish a plurality of apparatus each of which has a passage of a given width.

OBJECTS OF THE INVENTION

An object of the invention is to provide a band guiding and braking apparatus which can properly guide and/or otherwise influence wide or narrow as well as thick or thin bands or tapes with the same facility.

Another object of the invention is to provide an apparatus which can be readily affixed to or detached from conventional sewing machines including household sewing machines.

A further object of the invention is to provide a sewing machine which embodies the above outlined apparatus.

An additional object of the invention is to provide an apparatus which can be adjusted by hand rather than by a tool so as to offer an optimum resistance to advancement of a band or tape during sewing to a piece of fabric or a like commodity.

Still another object of the invention is to provide the apparatus with novel and improved means for rapidly converting it for use with wider or narrower bands.

A further object of the invention is to provide the apparatus with a novel and improved housing and with novel and improved means for biasing the band against the housing when the apparatus is in use.

An additional object of the invention is to provide an apparatus whose manipulation is simple so that it can be used by unskilled persons with a minimum of training or explanation.

Another object of the invention is to provide a novel and improved method of converting a standard household sewing machine for sewing of elastic or nonelastic bands or tapes to pieces of fabric or the like.

SUMMARY OF THE INVENTION

One feature of the invention resides in the provision of an apparatus which serves to guide and brake bands which are to be sewn to pieces of fabric or like commodities in sewing machines, such as household sewing machines. The apparatus comprises a preferably elongated housing defining a transversely extending channel for a band, and means for varying the effective width of the channel so that the latter can receive and the housing can properly guide narrower or wider bands. The housing preferably comprises a bottom section and a top section, and the varying means is preferably mounted in and is movable relative to the housing.

The apparatus further comprises biasing means which overlies the channel and the band in the channel, and means for moving the biasing means toward and away from the band in the channel. The width varying means is disposed in the housing at one side of the channel, and the apparatus preferably further comprises guide means for commodities; such guide means is then disposed at the other side of the channel.

The bottom section of the housing can constitute a substantially U-shaped trough with a pair of upwardly extending legs, and the top section of the housing can constitute an inverted U-shaped trough with a pair of downwardly extending legs. Each leg of one of the two pairs of legs at least partially overlies one leg of the other pair of legs, and the legs are formed with registering openings or windows (e.g., in the form of cutouts) which define the channel. The two sections of the housing, define an elongated passage which extends transversely of and communicates with the channel. A portion of the width varying means is preferably mounted in and is reciprocable longitudinally of the passage at one side of the channel. In accordance with a presently preferred embodiment, the width varying means has a substantially U-shaped cross-sectional outline and includes two spaced apart prongs and a web extending between and connecting the prongs to each other. The prongs can be provided with outwardly extending end portions which are disposed at the channel and alter the effective width of the channel in response to movement of the aforementioned portion of the width varying means in the passage.

The biasing means can comprise a substantially plate-like member which overlies the band in the channel, and the apparatus embodying such biasing means further comprises means for moving the plate-like member toward and away from the band in the channel. The plate-like member can be pivotably mounted in the housing and can be provided with a polished (i.e., smooth) surface which confronts the band in the channel. If the plate-like member has a polygonal outline, its corners are preferably rounded to offer less resistance to advancement of the band through the channel.

The guide means is preferably movable in or on the housing transversely of the channel opposite the width varying means. It is preferred to reciprocably mount the guide means on the top section of the housing. A yoke-like portion of the guide means preferably overlies a commodity during sewing of a band thereto.

Another feature of the present invention resides in the provision of a combination which is embodied in a sewing machine, such as a household sewing machine, and comprises a support and an apparatus for guiding and braking bands which are to be sewn to pieces of fabric or like commodities. The apparatus comprises an elongated tubular housing defining a transversely extending channel for a band, means for varying the effective width of the channel, guide means for commodities and means for biasing the band in the channel against the housing with a variable force. The width varying means is movably carried by the housing at one side of the channel, and the guide means is disposed at the other side of the channel and is movably mounted on the housing.

As already explained above, the housing can comprise a bottom section and a top section, and the biasing means can include a plate-like member which is disposed in the channel at a level above the band which extends through the channel. The plate-like member is movably mounted on the top section of the housing so that it is movable up and down away from and toward the band in the channel to thereby move away from and toward the band which extends through the channel between the bottom section of the housing and the plate-like member.

The combination preferably further comprises means for releasably coupling the housing to the support, e.g., to the table of a sewing machine. A portion of the width varying means is preferably slidable in and the guide means is preferably slidable on the housing. The biasing means is installed in the housing for movement up and down away from and toward the band in the channel.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
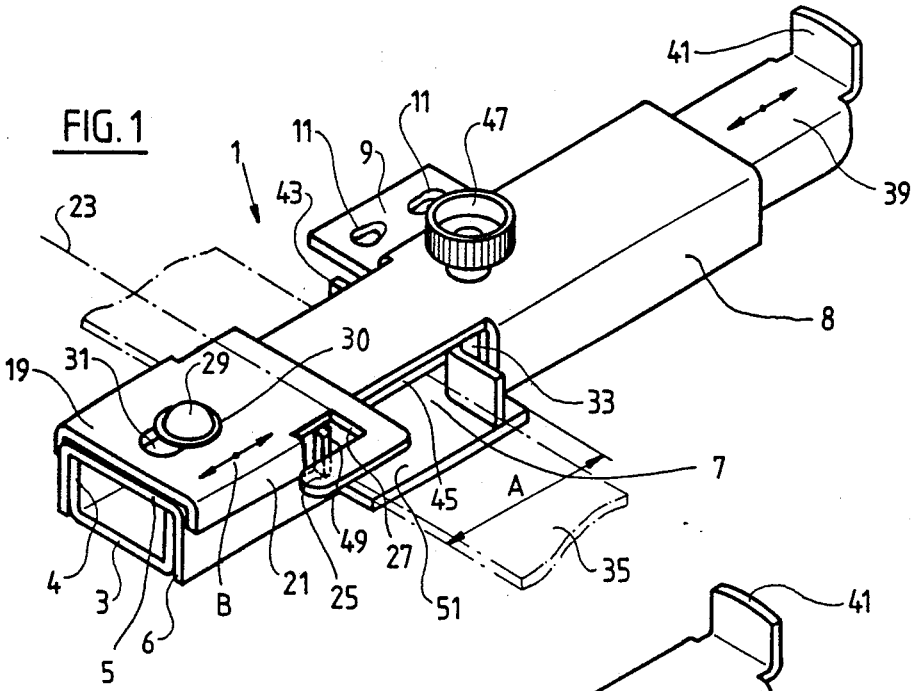
FIG. 1 is a perspective view of an apparatus which embodies one form of the invention, a portion of a band which extends through the variable-width channel of the apparatus being indicated by phantom lines.
Figure 2:
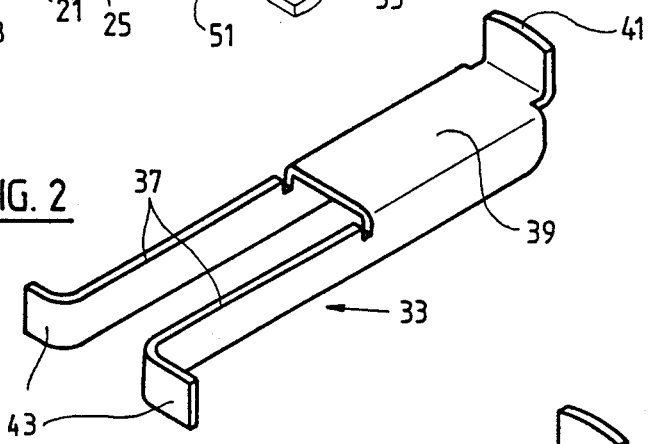
FIG. 2 is a perspective view of a device which is used to adjust the width of the channel for the band.
Figure 3:
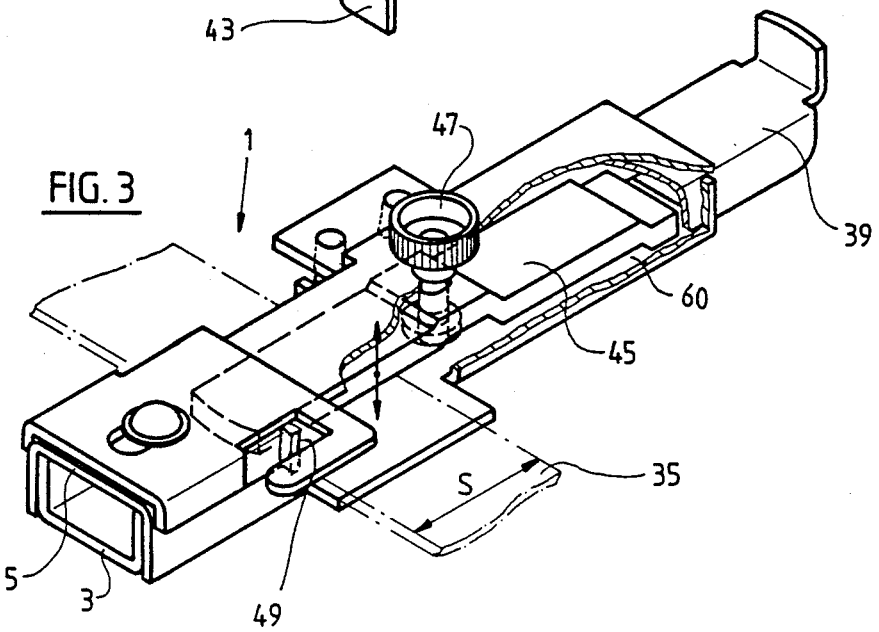
FIG. 3 shows the structure of FIG. 1 but with the housing of the apparatus partly broken away to reveal a larger portion of the biasing means.

Referring first to FIGS. 1 to 3, there is shown an apparatus 1 which can be installed in a household or industrial sewing machine 15 (FIG. 4) to facilitate the sewing of elastic or nonelastic bands or tapes 35 to marginal portions 23 of pieces 57 of fabric or like commodities, e.g., garments. The apparatus comprises an elongated hollow housing 8 which is assembled of a substantially U-shaped elongated bottom section 3 with two upwardly extending legs 4, and an inverted U-shaped top section 5 having two downwardly extending legs 6 each of which overlies one of the legs 4. The housing 8 has an elongated (flat) rectangular cross-sectional outline and is formed with a transversely extending channel 7 for a band 35 which is to be sewn to a piece 57 of fabric or the like. The channel 7 is defined by registering windows or openings in the form of cutouts or recesses which are machined into or otherwise formed in the legs 4 and 6. The channel 7 has an elongated rectangular cross-sectional outline. The reference character A denotes in FIG. 1 the maximum width of the channel 7, i.e., the maximum width of a band 35 which can be properly guided transversely through the housing 8 without buckling, i.e., so that the band is flat as shown in FIG. 1.

Figure 4:
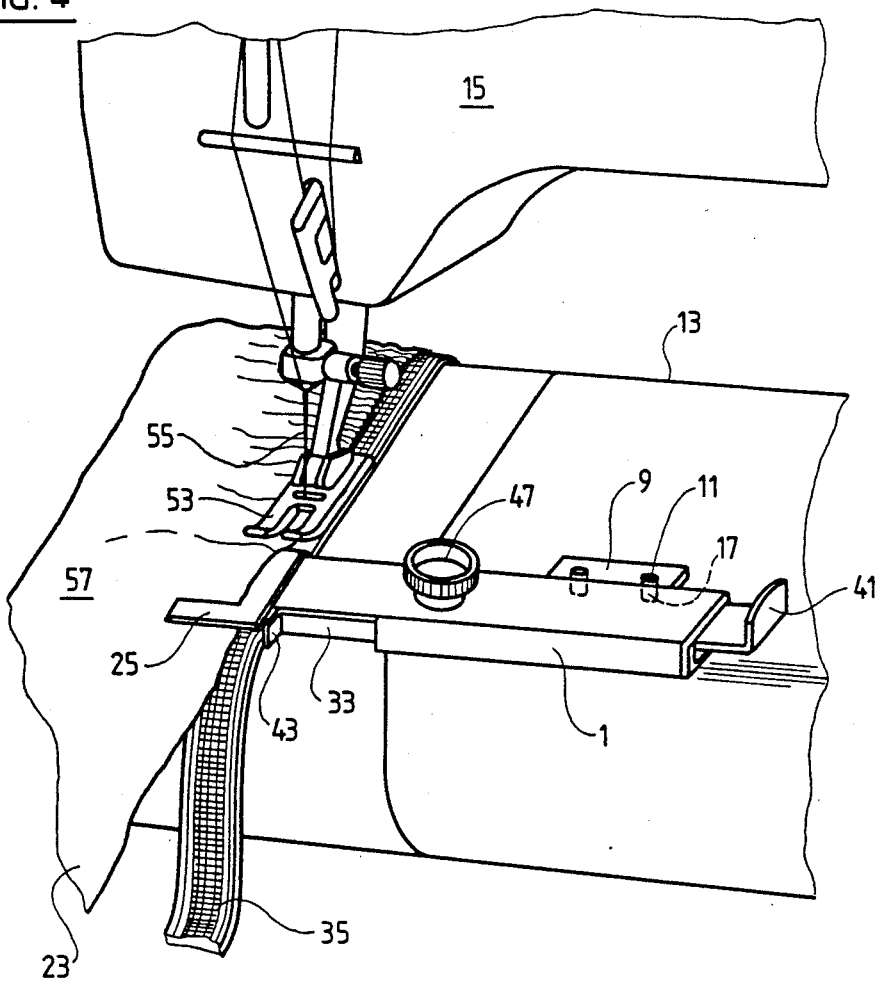
FIG. 4 is a fragmentary perspective view of a sewing machine and a smaller-scale view of the improved apparatus which is separably secured to the fabric-supporting table of the machine, and further showing a piece of fabric and a band which is in the process of being sewn to a marginal portion of the piece of fabric.

One of the downwardly extending legs 6 carries a plate-like coupling member 9 which extends laterally of the housing 8 and is provided with one, two or more downwardly extending locating pins 11 receivable in complementary holes or bores 17 in the table-like support 13 of the sewing machine 15 (see FIG. 4). The bores or holes 17 constitute standard features of many household sewing machines, i.e., such bores or holes need not be provided for the express purpose of facilitating or permitting coupling of the housing 8 to the table or support 13.

A fabric guide 19 is movably mounted on the upper or top section 5 of the housing 8 at the left-hand side of the channel 7. This guide has an edge face 27 which, engages and guides the marginal portion 23 of a piece 57 of fabric during sewing of a band 35 to the marginal portion in a manner as shown in FIG. 4. At such time, a yoke-like portion 25 overlies the marginal portion 23 of the piece 57 of fabric. The marginal portion 23 is indicated in FIG. 1 by a straight phantom line. The entire guide 19 can constitute a piece of metallic or plastic sheet material which is slidable at the outer side of the top section 5 of the housing in directions indicated by a double-headed arrow B. To this end, the guide 19 is formed with an elongated slot 31 which extends in the longitudinal direction of the housing 8 and receives the shank of a connector 29 overlying an elastic washer 30 or a like spring which offers a certain resistance to sliding movement of the guide 19 along the top section 5, i.e., it is necessary to forcibly move the guide 19 in order to place the edge face 27 into contact with the edge of the marginal portion 23. Stray movements of the guide 19 are prevented by two downwardly extending flanges 21 which overlap the respective legs 6 of the top section 5 to thus confine the guide 19 to movements in the longitudinal direction of the housing 8. The connector 29 can constitute a screw which is driven into the top section 5 or a rivet which is permanently secured to the section 5 and whose head is spaced apart from the upper side of the section 5 so as to provide room for the elastic washer 30. The length of the slot 31 determines the extent of movability of the guide 19 in the directions of arrow B.

The means for varying the effective width of the channel 7 comprises a slide 33 a portion of which is reciprocable in an elongated passage 60 within the housing 8 at the right-hand side of the channel 7. By moving in a direction to the left, the slide 33 reduces the effective width of the channel 7 so that such effective width matches the width s of the band 35 which extends through the channel 7. The illustrated slide 33 is made of a single piece of suitable metallic or plastic sheet material and comprises two elongated prongs 37 adjacent the inner sides of the legs 4 of the bottom section 3 of the housing 8, a web 39 which extends between and connects portions of the prongs 37 to each other, and an upwardly extending handle or handgrip portion 41 at the right-hand end of the web 39. The handle 41 can be pushed or pulled in order to overcome friction between the external surfaces of the slightly outwardly flaring elastic prongs 37 and the internal surfaces of the respective legs 4 when the operator wishes to alter the effective width of the channel 7. The free end portions 43 of the prongs 37 are bent outwardly and extend into the respective windows of the legs 4 and 6. The left-hand faces of the end portions 43 come into actual contact with the adjacent edge face of the band 35 in the channel 7. The elasticity of the prongs 37 and their mutual inclination suffice to ensure that the slide 33 remains in a selected position when the apparatus 1 is in actual use.

The means for biasing (and hence braking) the band 35 in the channel 7 comprises a plate-like biasing member 45 which is inserted into the upper portion of the channel 7 beneath the web of the top section 5 of the housing 8. The left-hand portion of the biasing member 45 overlies the band 35 in the channel 7, and the right-hand portion of the member 45 extends into the adjacent portion of the passage 60 and can pivot on the upper side of the web of the bottom section 3. To this end, the right-hand portion of the biasing member 45 is configurated in a manner as shown in FIG. 3, i.e., it is repeatedly bent so that its parts are disposed at several levels. The means for moving the biasing member 45 toward and away from the upper side of the band 35 in the channel 7 comprises a screw 47 which mates with the top section 5 and has a knurled head which can be engaged by two fingers to be turned clockwise or counterclockwise. The underside of the biasing member 45 in the channel 7 is preferably polished or otherwise finished to a high degree of smoothness. Furthermore, if the left-hand portion of the member 45 has a polygonal outline, its corners are preferably rounded to thus reduce the likelihood of accidentally blocking further movement of the band 35 transversely of the housing while the band is in the process of being sewn to a piece of fabric or the like. It is often desirable and advantageous to provide the left-hand portion of the biasing member 45 with a convex underside so as to reduce the area of contact with the upper side of the band 35 in the channel 7.

The legs 6 of the top section 5 of the housing 8 are preferably provided with outwardly bent lugs 49 (one shown in each of FIGS. 1 and 3) which are adjacent the respective side of the channel 7 opposite the end portions 43 of the prongs 37 forming part of the slide 33. Thus, one edge face of the band 35 in the channel 7 abuts the lugs 49 and the other edge face of the band abuts the end portions 43. Those portions of the legs 4 of the bottom section 3 which must be removed or pivoted in order to provide windows which define the channel 7 are preferably bent into the general plane of the web (bottom panel) of the bottom section 3 so that the thus bent portions of the legs 4 constitute the foremost and rearmost portions of a platform 51 along which the underside of the band 35 slides on its way through the channel 7. That portion of the platform 51 which is shown in FIGS. 1 and 3 is disposed beneath the respective end portion 43 and beneath the respective lug 49

FIG. 4 shows the apparatus 1 in operative position on the table or support 13 of the sewing machine 15. The holes or bores 17 are provided adjacent the front edge of the table 13 and they receive the locating pins 11 of the coupling member 9 so that the channel 7 is located in an optimum position with reference to the needle 55 and presser foot 53 of the machine 15. The band 35 extends through the channel 7 and is partially overlapped by the marginal portion 23 of the piece 57 of fabric. Such marginal portion is guided by the edge face 27 and is overlapped by the yoke-like portion 25 of the guide 19. If it is desired to provide a positive connection between the coupling member 9 and the table 13, the locating pins 11 are replaced by screws (not shown) which are driven into the respective bores or holes 17. Furthermore, and if it is desirable or necessary to adjustably secure the coupling member 9 to the table 13, the member 9 is provided with two or more elongated slots (not shown) which extend in parallelism with the passage 60 in the housing 8 and can receive shanks of screws which are driven into the bores or holes 17 and can be loosened to enable an operator to shift the entire housing 8 along the front edge of the table 13 before the screws are applied again to fixedly mount the apparatus 1 in the sewing machine 13.

The position of the marginal portion 23 of the piece 57 of fabric relative to the table 13, presser foot 53 and needle 55 can be adjusted by moving the housing 8 longitudinally of the front edge of the table 13 in the aforedescribed manner and/or by moving the guide 19 longitudinally of the top section 5 of the housing 8 against the opposition of the elastic washer 30. The band 35 is then caused to pass through the channel 7 and the effective width of this channel is then adjusted by the slide 33 so as to match the width s of the band. This ensures that a predetermined portion of the band 35 is overlapped by the marginal portion 23 of the piece 57 of fabric. The selected position of the slide 33 relative to the housing 8 remains unchanged in view of frictional engagement between the prongs 37 and the internal surfaces of the legs 4, and the selected position of the guide 19 remains unchanged in view of the provision of the aforediscussed elastic washer 30. The operator thereupon adjusts the level of the left-hand portion of the biasing member 45 by turning the knob of the screw 47 clockwise or counterclockwise in order to select the magnitude of frictional engagement between the underside of the member 45 and the upper side of the band 35 in the channel 7. This determines the extent to which the band 35 is expanded during sewing to the marginal portion 23 and hence the extent to which the marginal portion 23 is ruffled when the band 35 is permitted to contract upon completion of the sewing operation.

The configuration of the yoke-like portion 25 of the guide 19 is preferably such that the marginal portion 23 can slide along the upper side of the top section 5 with a minimum of friction while advancing toward the presser foot 53 of the sewing machine 15. On the other hand, the biasing member 45 brakes the band 35 with a desired force so as to determine the extent of ruffling of the marginal portion as a result of sewing of the band 35 thereto. The band 35 is advanced upwardly, as seen in FIG. 4, by the customary transporting element (not shown) beneath the presser foot 53.

The improved apparatus 1 can be used with equal or similar advantage to sew nonelastic bands to pieces of fabric, leather or the like. The biasing plate then merely serves as a guide for the upper side of the nonelastic band in the channel 7. Its braking action upon the upper side of the nonelastic band is minimal or nil.

An important advantage of the improved apparatus is that it can properly guide and brake relatively wide or relatively narrow bands with the same degree of accuracy. Moreover, the apparatus is simple and compact and can be installed in existing sewing machines without necessitating any alterations of such machines. Still further, the bias of the member 45 upon the band 35 in the channel 7 can be adjusted without resorting to any (even most rudimentary) tools, and such adjustment by means of the screw 47 necessitates a minimum of effort and can be carried out with a very high degree of accuracy.

Another important advantage of the improved apparatus is that it permits simple, accurate and convenient adjustment of the extent of overlap between the band in the channel 7 and the marginal portion of a piece of fabric or the like.

A further important advantage of the improved apparatus is that it can be used in sewing machines of all makes and types and that its application and manipulation can be readily understood by unskilled persons without any training or with a minimum of training, as a rule upon perusal of simple instructions. The housing 8 of the apparatus 1 can be affixed to or detached from a sewing machine by hand, even without the utilization of screwdrivers or similar simple and readily available tools.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for guiding and braking bands which are to be sewn to pieces of fabric or like commodities in a sewing machine, comprising a housing defining a transversely extending channel for a band; means for varying the effective width of said channel, said varying means being supported by said housing for movement relative thereto; biasing means overlying the band in said channel; and means for moving said biasing means toward and away from the band in said channel.

2. The apparatus of claim 1, wherein said housing is elongated and includes a bottom section and a top section, said varying means being mounted in said housing.

3. The apparatus of claim 1, wherein said housing includes a top section and a bottom section, said sections defining a passage extending transversely of said channel and said varying means including a portion which is reciprocably received in said passage at one side of said channel.

4. The apparatus of claim 1, wherein said varying means includes a portion movable in said channel transversely of the same.

5. In a sewing machine, particularly in a household sewing machine, the combination of a support with an apparatus for guiding and braking bands which are to be sewn to pieces of fabric or like commodities, said apparatus comprising an elongated tubular housing defining a transversely extending channel for a band, means for varying the effective width of said channel, said varying means being movably carried by said housing at one side of said channel, guide means for commodities, said guide means being disposed at the other side of said channel and being movably mounted on said housing, and means for biasing the band in said channel against said housing with a variable force.

6. The combination of claim 5, wherein said biasing means comprises a plate-like member disposed in said channel, said housing including a bottom section and a top section, and further comprising means for movably mounting said plate-like member on said top section so that the member is movable up and down away rom and toward said bottom section to thereby move away from or toward a band which extends through said channel between the bottom section and said member.

7. The combination of claim 5, further comprising means for releasably coupling said housing to said support.

8. The combination of claim 5, wherein said varying means includes a portion which is slidable in said housing and said guide means is slidably mounted on said housing.

9. The combination of claim 10, wherein said biasing means is installed in said housing for movement up and down away from and toward a band in said channel.

10. Apparatus for guiding and braking bands which are to be sewn to pieces of fabric or like commodities in a sewing machine, comprising a housing defining a transversely extending channel for a band; means for varying the effective width of said channel; biasing means overlying the band in said channel; means for moving said biasing means toward and away from the band in said channel; and guide means for commodities, said varying means being disposed at one side of said channel and said guide means being disposed at the other side of said channel.

11. Apparatus for guiding and braking bands which are to be sewn to pieces of fabric or like commodities in a sewing machine, comprising a housing defining a transversely extending channel for a band, said housing including an elongated U-shaped bottom section having a pair of upwardly extending legs and an inverted U-shaped top section having a pair of downwardly extending legs, each leg of one of said pairs at least partially overlying a leg of the other of said pairs and said legs having registering openings which define said channel; and means for varying the effective width of said channel.

12. Apparatus for guiding and braking bands which are to be sewn to pieces of fabric or like commodities in a sewing machine, comprising a housing defining a transversely extending channel for a band, said housing including a top section and a bottom section, and said sections defining a passage extending transversely of said channel; and means for varying the effective width of said channel, said varying means including a portion which is reciprocably received in said passage at one side of said channel, and said portion of said varying means having a substantially U-shaped crosssectional outline and including two spaced-apart prongs 13. The apparatus of claim 12, wherein said prongs have outwardly extending end portions which are disposed at said channel and alter the effective width of said channel in response to movement of said portion of said varying means in said passage.

14. Apparatus for guiding and braking bands which are to be sewn to pieces of fabric or like commodities in a sewing machine, comprising a housing defining a transversely extending channel for a band; means for varying the effective width of said channel, said varying means being supported by said housing for movement relative thereto; and means for biasing the band in said channel, said biasing means including a substantially plate-like member overlying the band in said channel and means for moving said plate-like member toward and away from the band in said channel.

15. The apparatus of claim 14, wherein said plate-like member is pivotably mounted in said housing.

16. The apparatus of claim 14, wherein said plate-like member has a smooth surface confronting the band in said channel.

17. The apparatus of claim 14, wherein said plate-like member has a polygonal outline with a plurality of rounded corners.

* * * * *